US006515412B1

(12) United States Patent
Ishitsuka et al.

(10) Patent No.: US 6,515,412 B1
(45) Date of Patent: Feb. 4, 2003

(54) FLUORESCENT LAMP

(75) Inventors: Shinichiro Ishitsuka, Osaka; Seido Tani, Kyoto; Yasuo Kuboki, Osaka; Hiroaki Higashino, Osaka; Kenji Hirai, Osaka, all of (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 105 days.

(21) Appl. No.: 09/694,948

(22) Filed: Oct. 24, 2000

(30) Foreign Application Priority Data

Oct. 29, 1999 (JP) ..... 11-309332
Jun. 8, 2000 (JP) ..... 2000-171551

(51) Int. Cl.[7] ..... H01J 1/62

(52) U.S. Cl. ..... 313/491; 313/318.05; 313/318.06; 313/318.01

(58) Field of Search ..... 313/318.01, 318.05, 313/318.06, 318.12, 484, 485, 491; 439/226, 243, 336

(56) References Cited

U.S. PATENT DOCUMENTS

| | | | | |
|---|---|---|---|---|
| 4,703,227 A | | 10/1987 | Takeda et al. | 313/634 |
| 4,767,965 A | * | 8/1988 | Yamano et al. | 313/491 |
| 5,161,884 A | * | 11/1992 | Siminovitch | 362/294 |
| 6,297,585 B1 | * | 10/2001 | Tashiro et al. | 313/318.08 |

FOREIGN PATENT DOCUMENTS

| | | |
|---|---|---|
| EP | 0 869 541 | 10/1998 |
| EP | 0 971 389 | 1/2000 |
| JP | 02-192650 | 7/1990 |
| JP | 04-061740 | 2/1992 |
| JP | 10-188906 | 7/1998 |
| JP | 11-111231 | 4/1999 |

OTHER PUBLICATIONS

European Search Report.

* cited by examiner

*Primary Examiner*—Robert H. Kim
*Assistant Examiner*—Therese Barber
(74) *Attorney, Agent, or Firm*—Merchant & Gould P.C.

(57) ABSTRACT

A fluorescent lamp includes a light-emitting tube having a pair of electrodes therein, a base in which the light-emitting tube is fixed, and a base contact pin terminal supported by the base with one end thereof projecting from the base. The base contact pin terminal is electrically connected to an electrode lead wire drawn from the light-emitting tube. The base is provided with a first power-conducting member including the base contact pin terminal having a lead plate, a connecting terminal having a lead plate and connected to the electrode lead wire, and a thermal protection element connected to the lead plate of the base contact pin terminal and the lead plate of the connecting terminal. The manufacturing processes of a fluorescent lamp provided with a thermal fuse are simplified and can be performed easily.

11 Claims, 20 Drawing Sheets

FIG. 13B
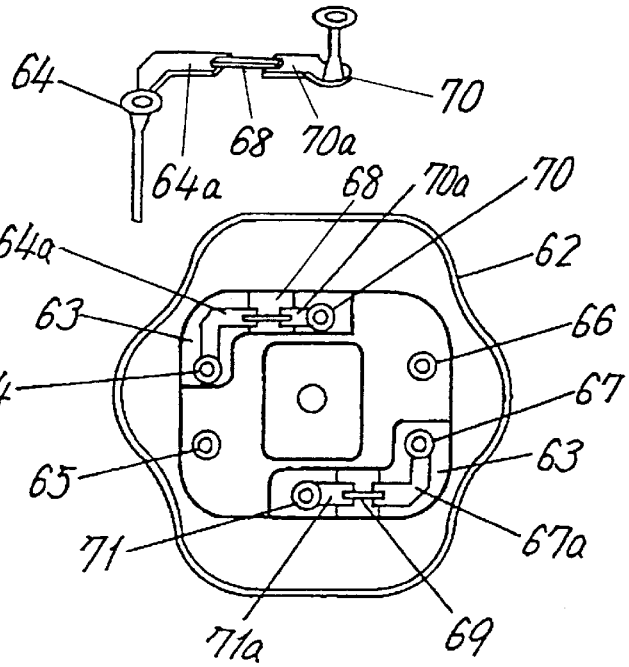
FIG. 13A
FIG. 14
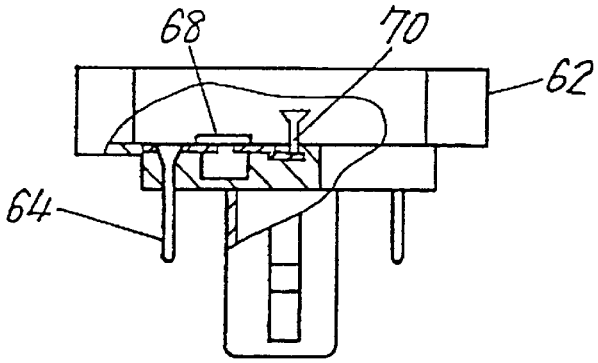
FIG. 15
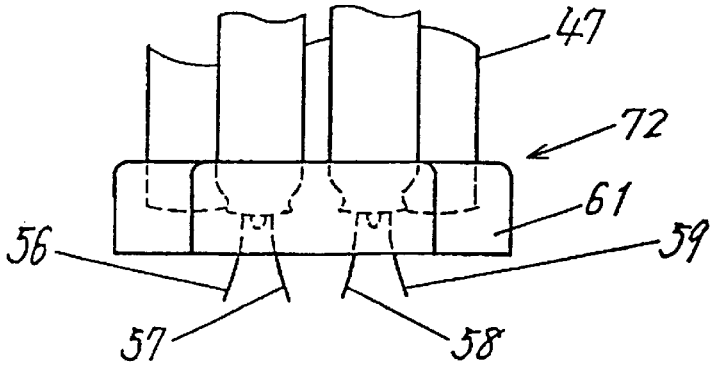

FIG. 16B
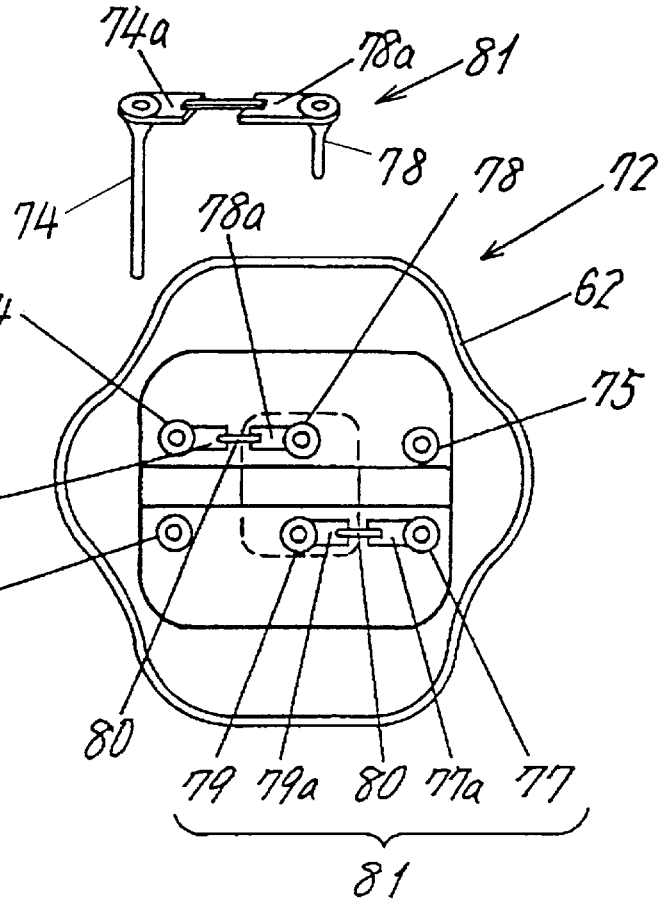
FIG. 16A
FIG. 17
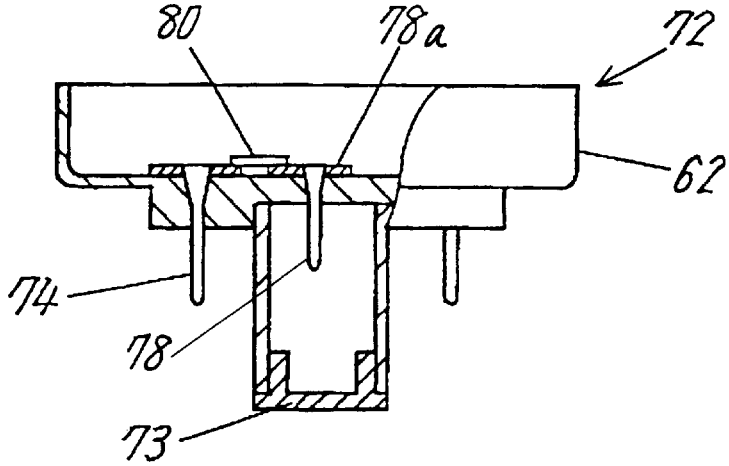

FLUORESCENT LAMP

BACKGROUND OF THE INVENTION

1. Field of the Invention

The present invention relates to a fluorescent lamp.

2. Description of the Related Art

Conventionally, during the last period of the life of a fluorescent lamp, when all electron emitting substances filled into an electrode filament coil dissipate, a cathode drop voltage rises and power consumption in an electrode increases. Thus, the temperature in the vicinity of an electrode sealing portion on the end of a light-emitting tube is excessively increased, and heat generation may occur. As a method for preventing such a rise in temperature or excessive heat generation from occurring, the following has been known: A thermal fuse or the like is provided in the vicinity of the end of the light-emitting tube. The excessive heat generated in the end of the light-emitting tube melts and cuts off this thermal fuse, so that a lighting circuit is interrupted (see JP 2-192650A and JP 4-61740A).

In recent years, a compact one-base-type fluorescent lamp with a small tube diameter has been developed and commercially expanded as an energy-saving light source to be substituted for light bulbs or the like. When such a fluorescent lamp is lit by a high-frequency electronic circuit, a preheating current may continue to flow through the electrode filament coil depending on the electronic circuit system, even if the lamp cannot light up because of the dissipation of all the electron emitting substances in the last period of lamp life.

In this case, the glass temperature of the electrode sealing portion rises excessively because an arc discharge or the like is generated between the electrode lead wires holding the electrode filament coil, thereby causing a breakdown. Thus, the preheating current flows in the glass between the electrode lead wires to increase the temperature of the electrode sealing portion excessively.

For one-base-type fluorescent lamps, a rise in temperature of the electrode sealing portion is especially remarkable, and thus a base made of a resin material may be deformed by heat. In order to prevent such a rise in temperature, the high-frequency electronic circuit is generally provided with a so-called protection circuit for detecting the dissipation of all the electron emitting substances in the electrode and stopping the electronic circuit operation. However, even if such a protection circuit is provided, the failure of the protection circuit, though it rarely occurs, may cause the above-mentioned base deformation or the like. As a method for preventing such a rise in temperature of the electrode sealing portion that leads to the base deformation or the like, the following has been known: A thermal protection element, such as a thermal fuse or the like is provided in the base so as to be connected in series with an outer electrode lead wire (see JP 10-188906A and JP 11-111231A).

FIG. 33 shows an example of a configuration of a one-base-type fluorescent lamp according to the conventional techniques. In a light-emitting tube 137 (with an outer diameter of about 17 mm) having a pair of electrodes therein, four straight glass tubes 138, 139, 140, and 141 are joined to form a discharge path therein. A base 142 is provided on the end of the tube of the light-emitting tube 137. Base contact pin terminals 145, 151, 152, and 153 are provided on the base 142 and connected to electrode lead wires 144, 148, 149, and 150 drawn from the light-emitting tube 137, respectively. In the base 142, a thermal protection element 143 that acts as a thermal fuse is connected to the electrode lead wire 144 drawn from the light-emitting tube 137 and the base contact pin terminal 145 by caulking.

In addition to the four straight tubes type described above, two, six, and eight straight tubes types conventionally have been known as the one-base-type fluorescent lamps. Among these types, e.g., in the one-base-type fluorescent lamp of four straight tubes type provided with the thermal protection element (hereinafter referred to as a thermal fuse) 143, as shown in FIG. 33, the base 142 generally includes a light-emitting tube holding member 146 and a base body 147 that mainly are made of a resin material, as shown in FIG. 34.

In the manufacturing processes for this type of fluorescent lamp, first, the ends of the four tubes of the light-emitting tube 137 are inserted into circular holes of the light-emitting tube holding member 146, and then fixed with an adhesive of a silicone resin or the like. Then, one end of the thermal fuse 143 and one end of the electrode lead wire 144 are connected. Then, the light-emitting tube holding member 146 and the base body 147 are fixed. Finally, the remaining three electrode lead wires 148, 149, and 150 and the other end of the thermal fuse 143 are connected to the base contact pin terminals 151, 152, 153, and 145 attached to the base body 147 by soldering or caulking. Also, in the two, six, and eight straight tubes types (with an outer diameter of the light-emitting tube of about 12 mm or about 17 mm), the base includes two parts that are basically the same as in the above four straight tubes type. In addition, the base assembly process is basically the same.

On the other hand, as an example of the kind of high wattage lamp of the two straight tubes type (with an outer diameter of the light-emitting tube of about 20 mm, and the electric power of 28 W. 36 W. 55 W, or 96 W), a lamp with the structure shown in FIGS. 35, 36, and 37 is provided. FIG. 35 is a sectional front view of a base portion, and FIGS. 36 and 37 are plan views thereof. In this lamp, a base 154 is provided with a base body 155, two covers 156, 157 shown in FIG. 37, and two thermal fuses 158, 159 shown in FIG. 36. FIG. 36 is a plan view of a base not including the covers 156, 157.

In the manufacturing processes for this type of fluorescent lamp, the thermal fuses 158, 159 are accommodated in the predetermined positions in the base body 155. Then, one side lead wire of each of the thermal fuses 158, 159 is inserted into respective base contact pin terminals 160, 161. At the same time, electrode lead wires 166, 167 drawn from a light-emitting tube 164 are inserted into base contact pin terminals 163, 162, respectively. Then, the light-emitting tube 164 is fixed in the base body 155 with a silicon adhesive or the like. The electrode lead wires 166, 167, and the one side lead wire of each of the thermal fuses 158, 159 that have been inserted into the base contact pin terminals 160, 161, 162, and 163, then are connected to the base contact pin terminals 160, 161, 162, and 163, respectively, by caulking. Furthermore, electrode lead wires 165, 168 and the other side lead wire of each of the thermal fuses 158, 159 are connected by caulking terminals 169 made of metal, and then the connected portions are inserted into the base body 155 to which the two covers 156, 157 are attached.

In a conventional fluorescent lamp without the thermal fuse, e.g., when a base is attached, electrode lead wires are arranged straight so as to be led to base contact pin terminals. Thus, when the end of a light-emitting tube is inserted into the base, the electrode lead wires spontaneously are led to and inserted into the corresponding base contact pin terminals, respectively. Therefore, for the conventional fluorescent lamp without the thermal fuse, the processes from the manufacture of a fluorescent lamp to base assembly generally are performed by a series of automatic manufacturing equipment or the like, so that mass production easily is achieved, and thus the manufacturing cost of lamps can be lowered.

However, for a conventional fluorescent lamp with the thermal fuse described above, in its manufacturing processes, it is difficult to connect the lead wires of the thermal fuse to an electrode lead wire of the light-emitting tube and a base contact pin terminal by automation, and thus these connections have to be established by manual operation. As a result, the manufacturing cost of lamps increases.

In a time of saving energy, to supply safe and popularly priced one-base-type fluorescent lamps to the market as an energy-saving light source to be substituted for light bulbs, reduction of the manufacturing cost of lamps provided with the thermal fuse is a task to be achieved.

SUMMARY OF THE INVENTION

Therefore, with the foregoing in mind, it is an object of the present invention to provide a fluorescent lamp that easily can achieve the mass production of lamps by a series of automatic manufacturing equipment or the like while simplifying the manufacturing processes of a fluorescent lamp provided with a thermal fuse and facilitating the operation thereof, and that can reduce the manufacturing cost significantly. It is another object of the present invention to provide a fluorescent lamp with excellent safety that ensures that the thermal fuse provided therein is melted and cut off as the temperature rises excessively in the last period of lamp life.

A fluorescent lamp of the present invention includes a light-emitting tube having a pair of electrodes therein, a base for fixing the light-emitting tube, and a base contact pin terminal supported by the base with one end thereof projecting from the base. The base contact pin terminal and an electrode lead wire drawn from the light-emitting tube are electrically connected. The base is provided with a first power-conducting member including the base contact pin terminal having a lead plate, a connecting terminal having a lead plate and connected to the electrode lead wire, and a thermal protection element connected to the lead plate of the base contact pin terminal and the lead plate of the connecting terminal.

This allows the manufacturing processes of a fluorescent lamp to be reduced and simplified in comparison with the conventional techniques. In addition, the mass production of lamps by a series of automatic manufacturing equipment or the like easily can be achieved, and thus the manufacturing cost required for producing fluorescent lamps can be reduced significantly. Furthermore, as the temperature rises excessively in the last period of lamp life, the thermal fuse provided in a lamp can be melted and cut off reliably, so that fluorescent lamps with excellent safety can be obtained.

These and other advantages of the present invention will become apparent to those skilled in the art upon reading and understanding the following detailed description with reference to the accompanying figures.

BRIEF DESCRIPTION OF THE DRAWINGS

FIG. 13A is a plan view for describing a base structure of the fluorescent lamp of FIG. 11.

FIG. 13B is a perspective view showing a power-conducting member of the base of FIG. 13A.

FIG. 14 is a partial sectional front view showing the base of FIG. 13A.

FIG. 15 is an enlarged front view showing a substantial part of a fluorescent lamp of a fifth embodiment of the present invention.

FIG. 16A is a plan view for describing a base structure of the fluorescent lamp of FIG. 15.

FIG. 16B is a perspective view showing a power-conducting member of the base of FIG. 16A.

FIG. 17 is a partial sectional front view of the base of FIG. 16A.

DESCRIPTION OF THE PREFERRED EMBODIMENTS

First Embodiment

Figure 1:
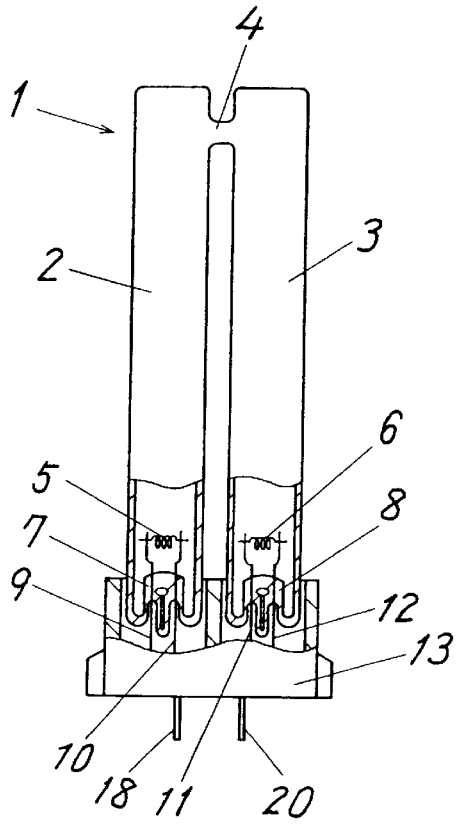
FIG.1 is a partial sectional front view showing a one-base-type fluorescent lamp of a first embodiment of the present invention.

FIG. 1 shows a one-base-type fluorescent lamp of the kind of high wattage lamp of the two straight tubes type, according to a first embodiment of the present invention. In a light-emitting tube 1, two straight glass tubes 2, 3 are joined with a so-called bridge junction 4. Thus, a discharge path is formed inside the light-emitting tube 1 between electrode filament coils 5 and 6 provided on the ends of both tubes. Electrode stems 7, 8 made of glass are fixed by sealing to the ends of both tubes of the light-emitting tube 1, respectively. Four electrode lead wires 9 and 10, 11 and 12 holding the electrode filament coils 5, 6, respectively, are fixed by sealing to the electrode stems 7, 8. The four electrode lead wires 9, 10, 11, and 12 are drawn out of the light-emitting tube 1. The light-emitting tube 1 is filled with an inert gas such as argon or the like and mercury, and phosphors are applied to the inner surface thereof. As a completed lamp, a base 13 is fixed on both ends of the light-emitting tube 1 with an adhesive (not shown) of a silicone resin or the like. Numerals 18, 20 denote the base contact pin terminals.

Figure 2:
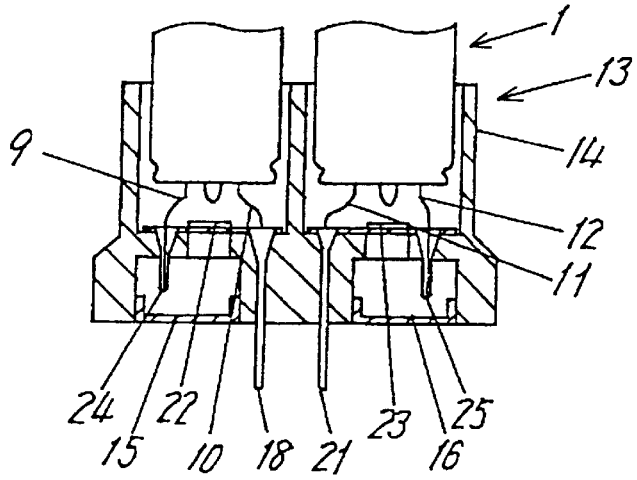
FIG. 2 is an enlarged sectional front view showing a substantial part of the fluorescent lamp of FIG. 1.
Figure 3:
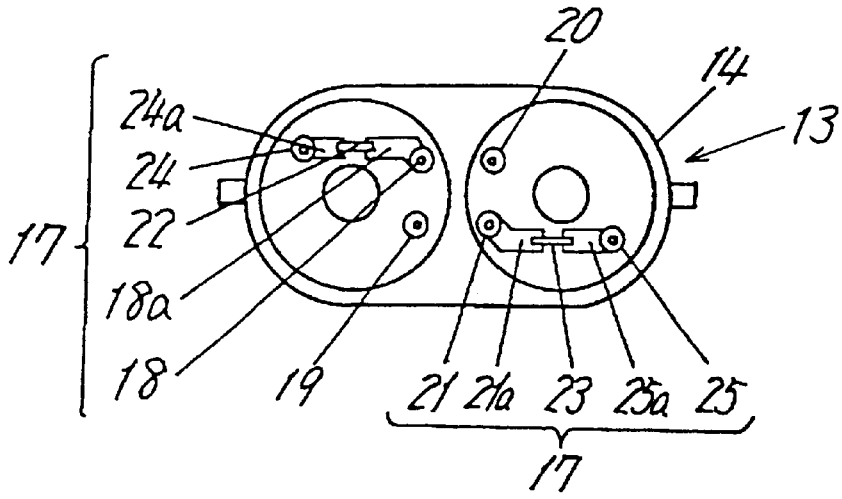
FIG. 3 is a plan view showing a base of the fluorescent lamp of FIG. 1.
Figure 4:
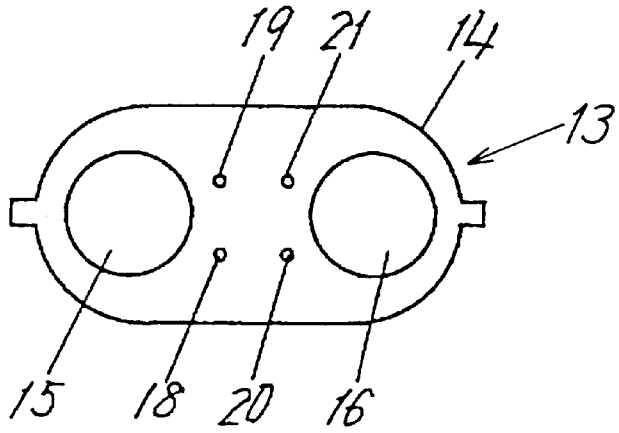
FIG. 4 is a bottom view of the base of FIG. 3.

FIGS. 2, 3, and 4 show the structure of the base 13 in detail. The base 13 includes a base body 14 and covers 15, 16. The base body 14 is made of a resin material, such as polyethylene terephthalate (hereinafter referred to as PET). As shown in FIG. 3, first power-conducting members 17 are fixed to the base body 14.

Figure 5:
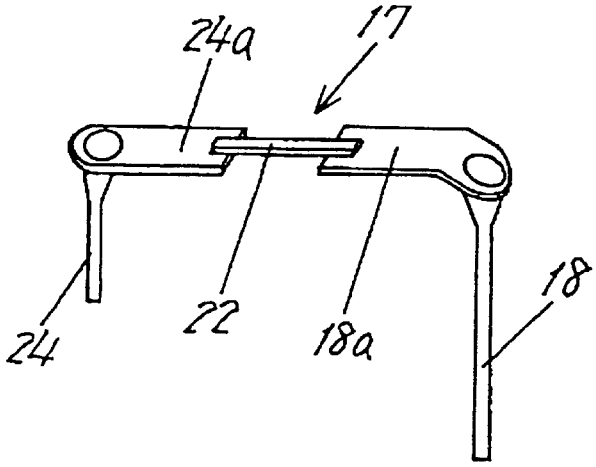
FIG. 5 is a perspective view showing a power-conducting member of the base of FIG. 3.

As shown in FIG. 5, the first power-conducting members 17 include at least three types of metal parts, i.e., four base contact pin terminals 18, 19, 20, and 21, thermal protection elements (hereinafter referred to as a thermal fuse) 22, 23, and pin-shaped connecting terminals 24, 25. The base contact pin terminals 18, 19, 20, and 21 are drawn out of the base 13 and connected to the lead wires of an outer electronic lighting circuit or the like. The thermal fuses 22, 23 are made of metal having a low melting point of 168° C. The electrode lead wires 9, 12 drawn from the light-emitting tube 1 are connected to the connecting terminals 24, 25. FIG. 5 shows one of the first power-conducting members 17; the other has the same structure.

In the first power-conducting members 17, the base contact pin terminal 18 or 21 and the connecting terminal 24 or 25 are connected via the thermal fuse 22 or 23. In order to establish the connections between the base contact pin terminals 18, 21 and the connecting terminals 24, 25 more easily, lead plates 18*a*, 21*a* are attached to the base contact pin terminals 18, 21 and lead plates 24*a*, 25*a* are attached to the connecting terminals 24, 25, respectively, as an integral part. The base contact pin terminals 18, 21 and the lead plates 18*a*, 21*a*, and the connecting terminals 24, 25 and the lead plates 24*a*, 25*a*, respectively, are made of a metal material of brass or nickel or the like as an integrally formed metal part. Both ends of the thermal fuses 22, 23 are connected to one end of each of the lead plates 18*a*, 24*a*, 21*a* and 25*a*, respectively. Since the thermal fuses 22, 23 are metal with a low melting point, i.e. a so-called solder, the electrical connections between the thermal fuses 22, 23 and the lead plates 18*a*, 24*a*, 21*a*, and 25*a* are easily established by soldering.

Furthermore, in this embodiment, when the base 13 is formed, part of the first power-conducting members 17 is embedded in the base 13 so that the base 13 is integral with the first power-conducting members 17. The portion of the first power-conducting members 17 embedded in the base 13 is chosen so as not to cause interference with the connection to an outer electronic lighting circuit, the thermal fuses 22, 23, or the electrode lead wires 9, 12 or the like.

An example of the manufacturing processes of the base 13 is as follows: First, at the same time as resin molding of the base body 14, the base contact pin terminals 18, 19, 20 and 21 and the connecting terminals 24, 25 are installed to form an integral part of the base body 14. Then, the thermal fuses 22, 23 are soldered to one end of each of the lead plates 18*a*, 21*a*, 24*a*, and 25*a*.

In the manufacturing process of another example, first, the base body 14 is formed by resin molding. Then, the base contact pin terminals 18, 19, 20, and 21 and the connecting terminals 24, 25 that constitute the first power-conducting members 17 are forced into the predetermined positions of the base body 14 to be attached thereto, and thus the base body 14 is completed. Then, the thermal fuses 22, 23 are soldered to one end of each of the lead plates 18*a*, 21*a*, 24*a*, and 25*a*, respectively. The thermal fuses 22, 23 may be fixed previously inside the base 13 by soldering. Alternatively, the thermal fuses 22, 23 may be soldered after the fluorescent lamp manufacturing process (a) or (b), which will be described later.

The covers 15, 16 are made of a resin material of PET or the like and cover the thermal fuses 22, 23 or the connecting terminals 24, 25 or the like inside the base body 14 so that they cannot be seen from the outside, as shown in FIG. 2. This can provide an appearance that does not reduce the commercial value of the product because the parts of the lead plates or the like or wiring points inside the base are covered and cannot be seen. Two covers 15, 16 are used in this embodiment as shown in FIGS. 1 to 4. However, as will be described later, the covers 15 and 16 can be formed into one part.

As described above, in this embodiment, at least part of the base contact pin terminal and the connecting terminal, or at least part of each lead wire provided on the base contact pin terminal and the connecting terminal is embedded in the base. According to this configuration, since the first power-conducting members 17 including the base contact pin terminals 18, 19, 20, and 21, the thermal fuses 22, 23, and the connecting terminals 24, 25 are wired beforehand and placed in the base 13, a fluorescent lamp with the thermal fuse can be obtained by the same processes as in a fluorescent lamp without the thermal fuse. Therefore, the manufacturing processes of a fluorescent lamp can be reduced and simplified in comparison with those of the conventional fluorescent lamp with a thermal fuse. In addition, it is possible easily to realize the mass production of lamps by automation and to reduce the manufacturing cost required for producing fluorescent lamps significantly.

The manufacturing processes of a fluorescent lamp of this embodiment can be performed as follows:

(a) The end of the light-emitting tube 1 is installed in the base body 14, and then fixed by injecting an adhesive (not shown) of a silicone resin or the like into the gap between the end of the tube of the light-emitting tube 1 and the base body 14. In this installation, two electrode lead wires 9, 12 are inserted into the connecting terminals 24, 25, respectively, and the other two electrode lead wires 10, 11 are inserted into the base contact pin terminals 19, 20, respectively.

(b) Then, by caulking each of the terminals 19, 20, 24 and 25, the electrode lead wires 9, 10, 11, and 12 are connected to each of the terminals 19, 20, 24, and 25.

(c) Thereafter, each of the covers 15, 16 is attached to the base body 14.

The thermal fuses 22, 23 can be inserted from the opposite side of the light-emitting tube 1 with respect to the base body 14 and connected to each of the lead plates 18*a*, 24*a*, 21*a*, and 25*a*.

Second Embodiment

Figure 6:
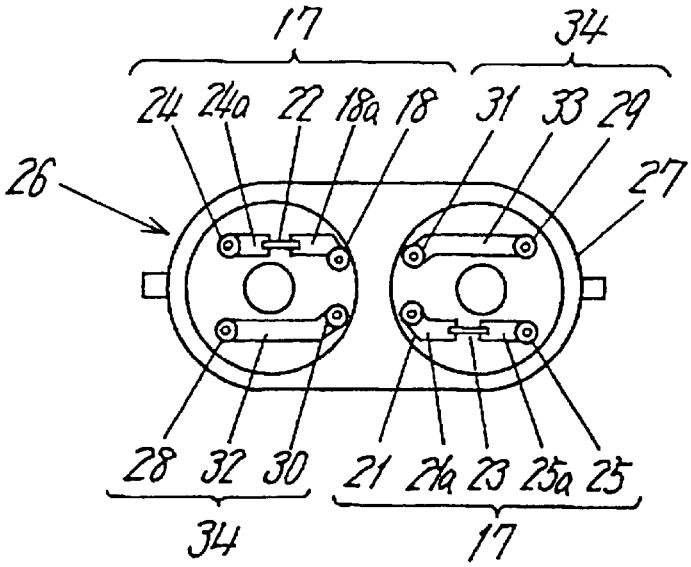
FIG. 6 is a plan view showing a base of a fluorescent lamp of a second embodiment of the present invention.
Figure 7:
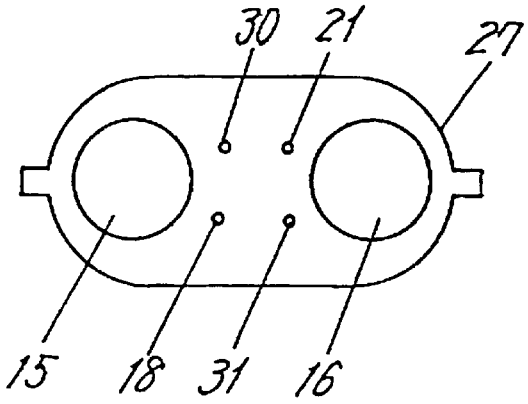
FIG. 7 is a bottom view of the base of FIG.6.

Abase 26 of a fluorescent lamp of a second embodiment of the present invention will be described with reference to FIGS. 6 and 7.

The base 26 has a partly modified structure of the base 13 of the first embodiment. Therefore, the identical elements to those of the first embodiment are denoted by the same reference numerals, and repetition of the description will be omitted. In addition to first power-conducting members 17, second power-conducting members 34 are incorporated in a base body 27. The second power-conducting members 34 include connecting terminals 28, 29 to which electrode lead wires 10, 11 are connected. The connecting terminal 28 or 29 and the base contact pin terminal 30 or 31 are integrally formed via lead plate 32 or 33.

Other base structure and assembly process are basically the same as in the first embodiment.

Third Embodiment

Figure 8:
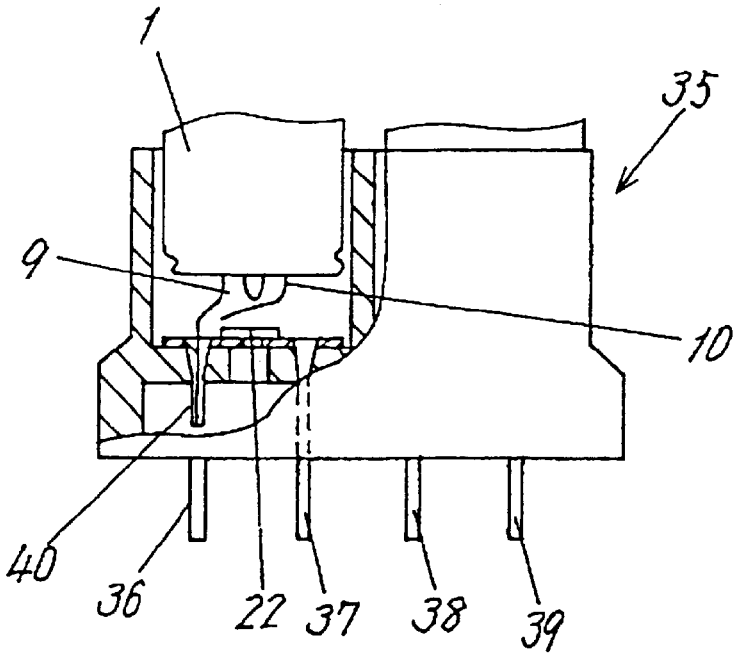
FIG. 8 is a partial sectional front view showing a substantial part of a fluorescent lamp of a third embodiment of the present invention.
Figure 9:
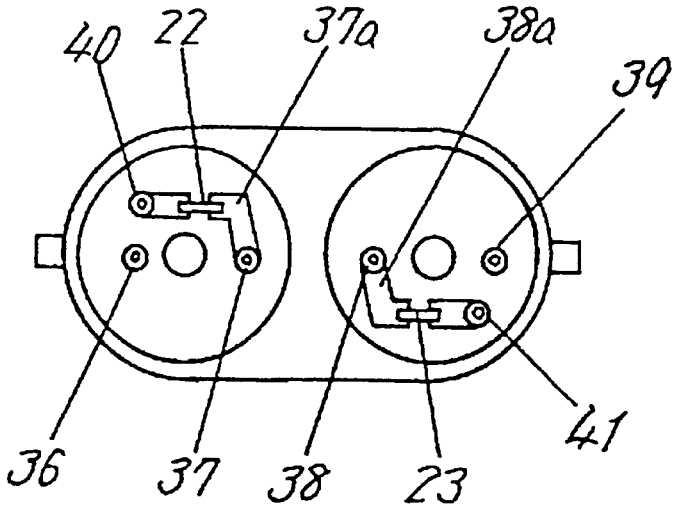
FIG. 9 is a plan view showing a base of the fluorescent lamp of FIG. 8.
Figure 10:
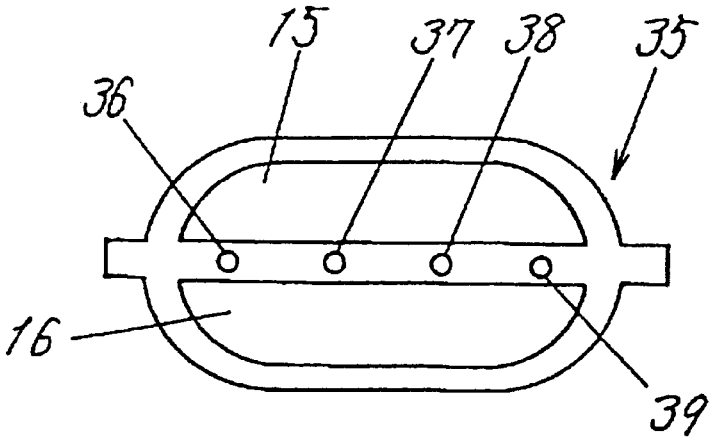
FIG. 10 is a bottom view of the base of FIG. 9.

A base 35 of a fluorescent lamp of a third embodiment of the present invention will be described with reference to FIGS. 8 to 10.

In the base 35, four base contact pin terminals 36, 37, 38, and 39 are arranged linearly. With the linear arrangement of the base contact pin terminals 36, 37, 38, and 39, the shapes or the positions of installation or the like of connecting terminals 40, 41, the base contact pin terminals 37, 38, lead plates 37*a*, 38*a*, covers 15, 16, or the like are modified appropriately. The electrode lead wires 9, 12 and 10, 11 are inserted into and connected to the connecting terminals 40, 41 and the base contact pin terminals 36, 39, respectively.

Fourth Embodiment

Figure 11:
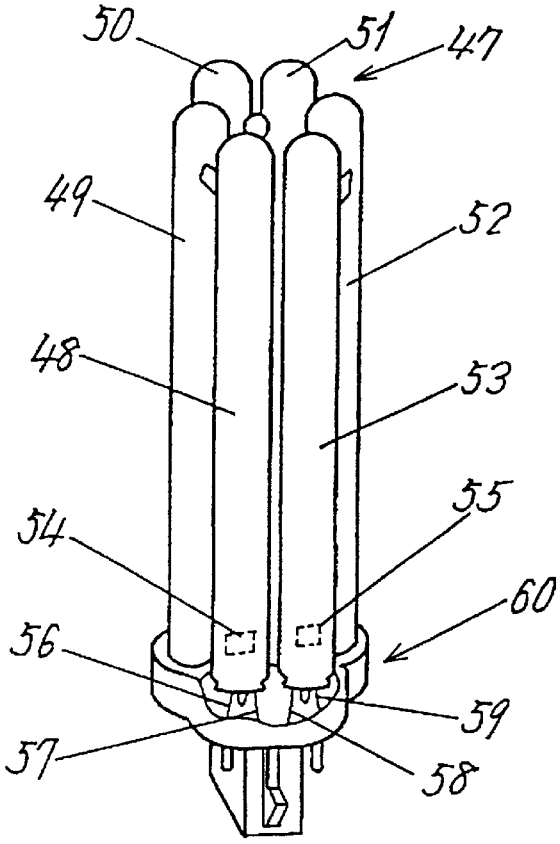
FIG. 11 is a partial sectional perspective view showing a fluorescent lamp of a fourth embodiment of the present invention.

FIG. 11 shows a one-base-type fluorescent lamp of the six straight tubes type of a fourth embodiment of the present invention. In a light-emitting tube 47 of this embodiment, six straight glass tubes 48, 49, 50, 51, 52, and 53 are joined with bridge junctions. Thus, a discharge path is formed inside the light-emitting tube 47 between electrode filament coils 54 and 55 provided on the both ends of the tube. Four electrode lead wires 56, 57, 58, and 59 are drawn out of the light-emitting tube 47. Like each of the above embodiments, the light-emitting tube 47 is fixed in a base 60 with an adhesive (not shown) of a silicone resin or the like.

Figure 12:
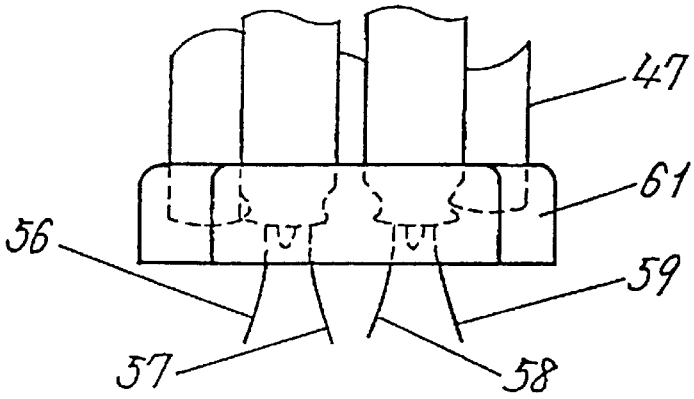
FIG. 12 is an enlarged front view of a substantial part of the fluorescent lamp of FIG. 11.

FIGS. 12 to 14 show the base 60 in detail. The base 60 includes a light-emitting tube holding member 61 and a base body 62. The light-emitting tube holding member 61 is made of a resin material of PET or the like and holds the light-emitting tube 47 fixed with an adhesive or the like. The base body 62 is made of a resin material of PET or the like, to which first power-conducting members 63 are fixed as an integral part.

As shown in FIG. 13A, the first power-conducting members 63 include, like each of the above embodiments, four base contact pin terminals 64, 65, 66, and 67, thermal fuses 68, 69, and pin-shaped connecting terminals 70, 71 to which the electrode lead wires 56, 59 are connected. The connecting terminals 70, 71 are provided so as to extend to the light-emitting tube 47 side.

In the first power-conducting members 63, as shown in FIG. 13B, the base contact pin terminals 64 (67) and the connecting terminals 70 (71) are connected via the thermal fuses 68 (69). In order easily to establish the connections between the base contact pin terminals 64, 67 and the connecting terminals 70, 71, lead plates 64*a*, 67*a*, 70*a*, and 71*a* are attached to the base contact pin terminals 64, 67 and the connecting terminals 70, 71, respectively, as an integral part. The electrical connections between the thermal fuse 68 and the lead plates 64*a*, 70*a*, and between the thermal fuse 69 and the lead plates 71*a*, 67*a* are established easily by soldering.

As an example of the manufacturing processes of forming the base body 62, the following processes, which are the same as in the first embodiment, can be used. First, at the same time as resin molding of the base body 62, the base contact pin terminals 64, 65, 66, and 67 and the connecting terminals 70, 71 are installed to form an integral part of the base body 62. Then, the thermal fuses 68, 69 are soldered to one end of each of the lead plates 64*a*, 70*a*, 67*a*, and 71*a*.

As the manufacturing processes of another example, the following processes can be used. First, the base body 62 is formed by resin molding. Then, the base contact pin terminals 64, 65, 66, and 67 and the connecting terminals 70, 71 that constitute the first power-conducting members 63 are forced into the predetermined positions of the base body 62 to be attached thereto, and thus the base body 62 is completed. Then, the thermal fuses 68, 69 are soldered to one end of each of the lead plates 64*a*, 70*a*, 67*a*, and 71*a*, respectively. The thermal fuses 68, 69 may be fixed previously inside the base 60 by soldering. Alternatively, the thermal fuses 68, 69 may be soldered after the fluorescent lamp manufacturing process (a) or (b), which will be described below.

The manufacturing processes of a fluorescent lamp of this embodiment may include the following:

(a) First, the end of the light-emitting tube 47 is installed in the light-emitting tube holding member 61, and then fixed with an adhesive of a silicone resin or the like.

(b) Then, the electrode lead wires 56, 59 are inserted into the connecting terminals 70, 71, respectively. At the same time, the electrode lead wires 57, 58 are inserted into the base contact pin terminals 65, 66, respectively. By caulking each of the terminals 70, 71, 65, and 66, the electrode lead wires 56, 57, 58, and 59 are connected to each of the terminals 70, 71, 65, and 66.

(c) Finally, the light-emitting tube holding member 61 is attached to the base body 62.

Fifth Embodiment

A base 72 of a fluorescent lamp of a fifth embodiment of the present invention will be described with reference to FIGS. 15 to 17.

The base 72 includes a light-emitting tube holding member 61, a base body 62, and a cover 73 made of a resin material of PET or the like. The base 72 has a slightly modified structure of the base 60 of the fourth embodiment. In other words, as shown in FIGS. 16A and 17, it differs from the fourth embodiment in the shapes and the positions of installation of first power-conducting members 81, i.e., base contact pin terminals 74, 75, 76, and 77, connecting terminals 78, 79, lead plates 74*a*, 78*a*, 77*a*, and 79*a*, and thermal fuses 80. The connecting terminals 77, 78 are provided so as to extend downward, as shown in FIGS. 16B and 17.

The manufacturing processes of a fluorescent lamp of this embodiment can be performed as follows: First, while the electrode lead wires 56, 59 of the light-emitting tube 47 held by the light-emitting tube holding member 61 are inserted into the connecting terminals 78, 79 and the electrode lead wires 57, 58 are inserted into the base contact pin terminals 75, 76, respectively, the base body 62 is attached to the light-emitting tube holding member 61. Thereafter, the four electrode lead wires 56, 57, 58, and 59 are connected to each of the corresponding terminals by caulking. Then, the cover 73 is attached to the base body 62 to cover the connecting terminals 78, 79 or the like so that they cannot be seen.

Sixth Embodiment

Figure 18:
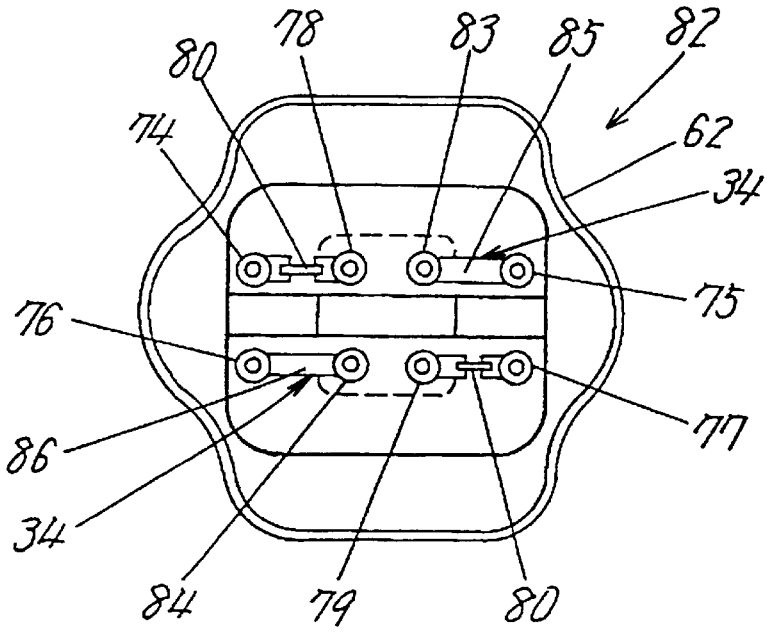
FIG. 18 is a plan view showing a base of a fluorescent lamp of a sixth embodiment of the present invention.
Figure 19:
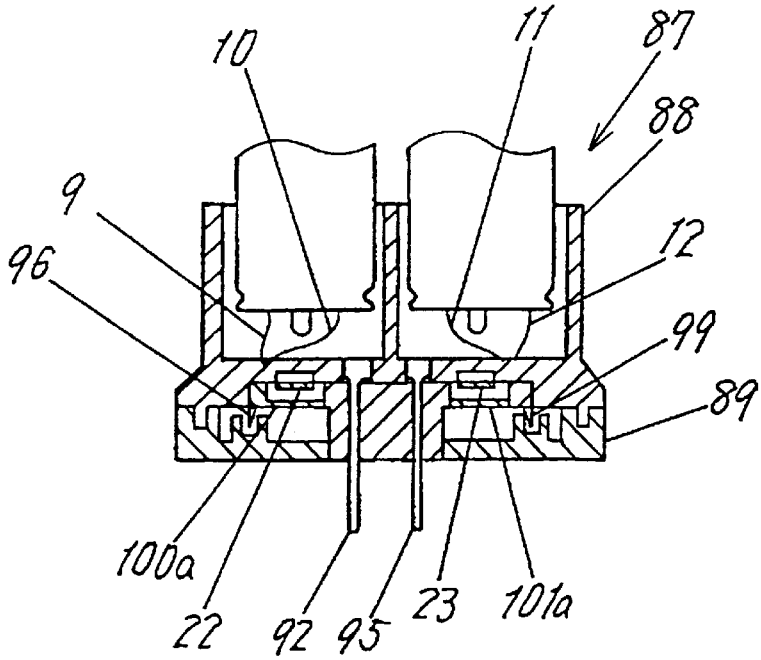
FIG. 19 is a sectional front view showing a substantial part of a fluorescent lamp of a seventh embodiment of the present invention.
Figure 20:
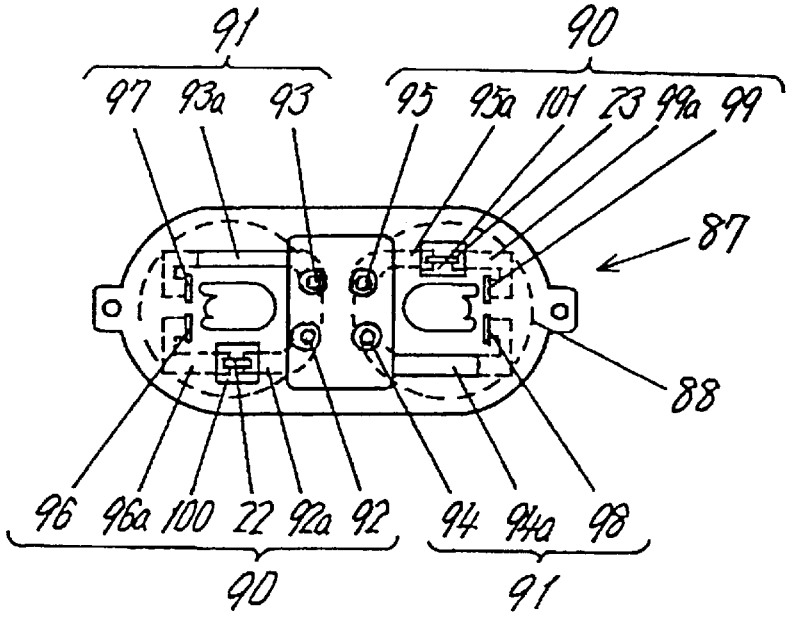
FIG. 20 is a bottom view showing a base body of the fluorescent lamp of FIG. 19.
Figure 21:
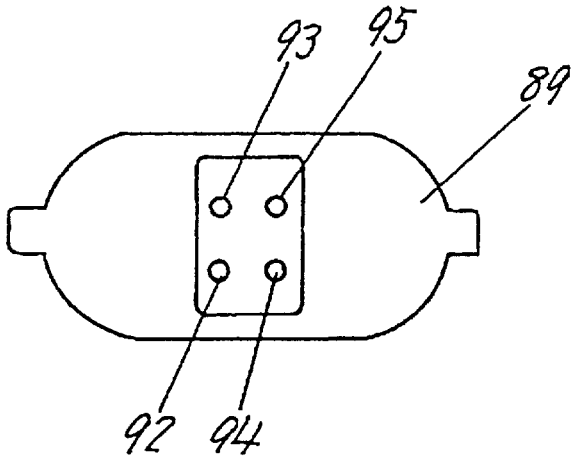
FIG. 21 is a bottom view of a base including the base body of FIG. 20 provided with a cover.

A base 82 of a fluorescent lamp of a sixth embodiment of the present invention will be described with reference to FIG. 18.

The base 82 has a slightly modified structure of the base body 62 of the fifth embodiment. In other words, connecting terminals 83, 84 are provided, and the connecting terminals 83, 84 and the base contact pin terminals 75, 76 are connected via lead plates 85, 86 to form second power-conducting members 34.

Seventh Embodiment

A base 87 of a fluorescent lamp of a seventh embodiment of the present invention will be described with reference to FIGS. 19 to 25.

Figure 22A:
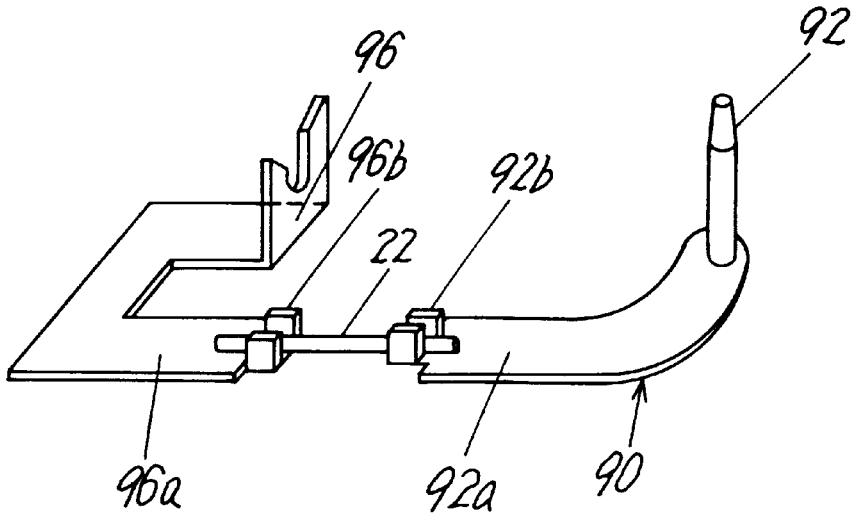
FIG. 22A is a perspective view showing a first power-conducting member of the base body of FIG. 20.
Figure 22B:
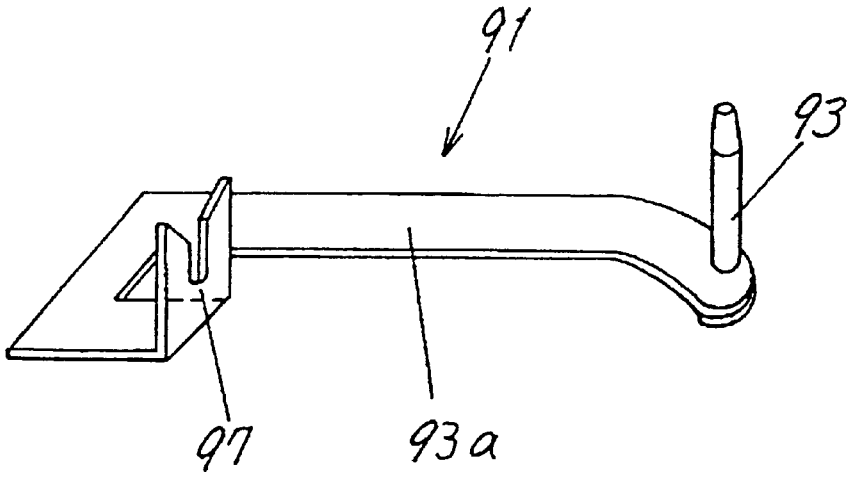
FIG. 22B is a perspective view showing a second power-conducting member of the base body of FIG. 20.

The base 87 includes a base body 88 and a cover 89. First power-conducting members 90 and second power-conducting members 91 are fixed to the base 87. As shown in FIG. 22A, the first power-conducting members 90 include three major metal parts, i.e., base contact pin terminals 92 (95), thermal fuses 22 (23), and slit-forming connecting terminals 96 (99). As shown in FIG. 22B, the second power-conducting members 91 include two major metal parts, i.e., base contact pin terminals 93 (94), and slit-forming connecting terminals 97 (98). The base contact pin terminals 92, 93, 94, and 95 are drawn out of the base 87 and connected to the lead wires of an outer electronic lighting circuit or the like. The electrode lead wires 9, 10, 11, and 12 drawn from the light-emitting tube 1 are connected to the connecting terminals 96, 97, 98, and 99.

In the first power-conducting members 90, the base contact pin terminals 92, 95 and the connecting terminals 96, 99 are connected via the thermal fuses 22, 23. The base contact pin terminals 92, 95 are attached to one end of each of lead plates 92*a*, 95*a*, respectively, by caulking. The connecting terminals 96, 99 are integrally formed at one end of each of the lead plates 96*a*, 99*a*, respectively. Both ends of the thermal fuse 22 are connected to the connecting terminals 92b and 96*b*, respectively. The connecting terminals 92*b*, 96b are provided on the other end of each of the lead plates 92*a*, 96*a* and have a slit or a groove or the like. Similarly, both ends of the thermal fuse 23 also are connected to the connecting terminals on the other end of each of the lead plates 95*a*, 99*a*. The electrical connections between the thermal fuse 22 and the lead plates 92*a*, 96*a*, and between the thermal fuse 23 and the lead plates 95*a*, 99*a* easily are established in such a manner that the ends of the thermal fuse 22 or 23 are inserted into the connecting terminals 92*b* and 96*b*, or the like of the corresponding lead plates to be caulked and soldered.

On the other hand, in the second power-conducting members 91, the base contact pin terminal 93 or 94 and the connecting terminal 97 or 98 are connected by lead plate 97*a* or 98*a*. The connecting terminals 97, 98 are formed integrally at one end of each of the lead plates 97*a*, 98*a*, respectively. The base contact pin terminals 93, 94 are attached to the other end of each of the lead plates 97*a*, 98*a* by caulking.

Accommodating holes 100, 101 in which the thermal fuses 22, 23 are accommodated are formed in the base body 88. The lead plates 92*a*, 95*a* and the lead plates 96*a*, 99*a* (along with the base contact pin terminals 92, 95 and the connecting terminals 96, 99) are embedded in the base body 88 so that the ends of the lead plates to which the thermal fuses 22, 23 are connected are positioned inside the accommodating holes 100, 101. The thermal fuses 22, 23 are accommodated in the accommodating holes 100, 101 and connected to the end of each of the lead plates 92*a*, 95*a* and 96*a*, 99*a*, respectively. In the plan view of FIG. 20, the portion of each lead plate embedded into the base body is shown in broken lines.

Figure 23:
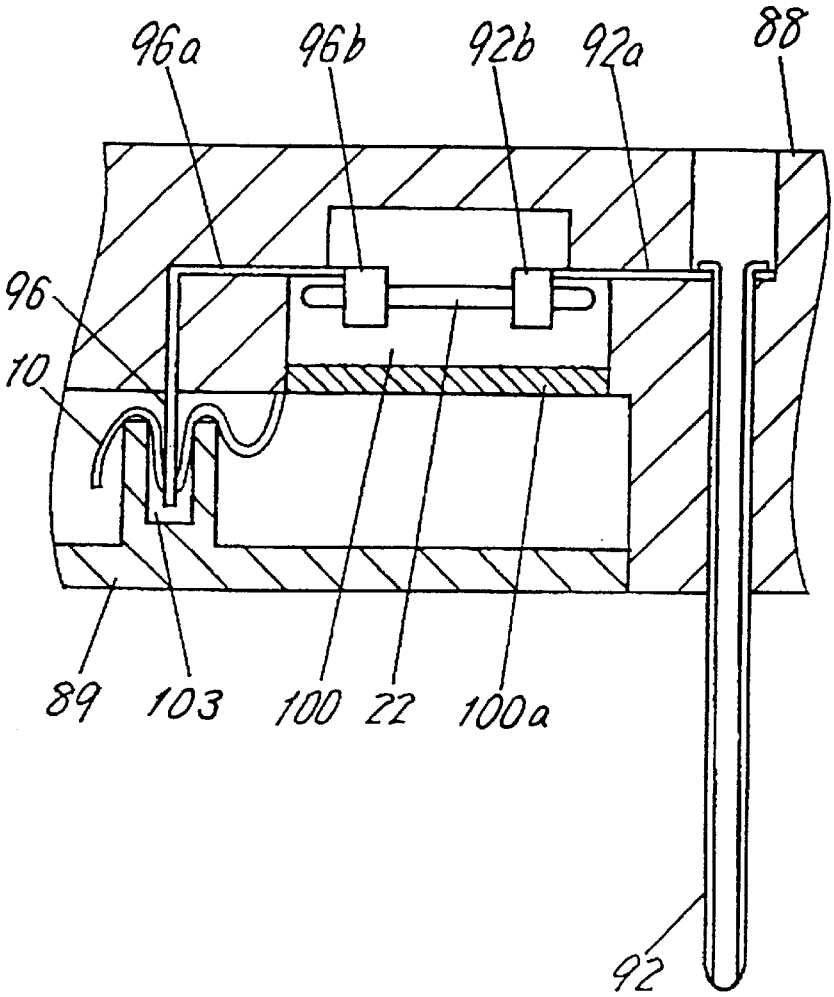
FIG. 23 is an enlarged sectional front view showing a substantial part of the base body of FIG. 20.
Figure 24:
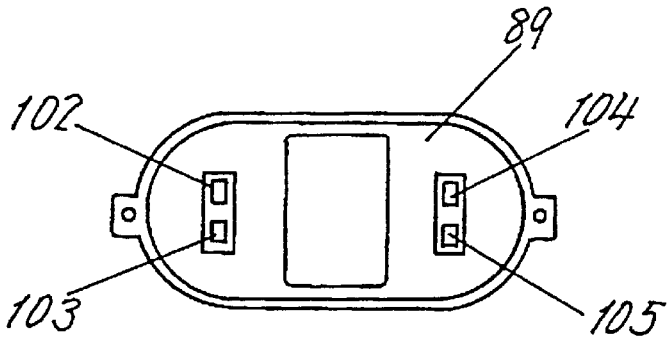
FIG. 24 is a front view showing a cover of the base body of FIG. 20.

As shown in FIG. 24, a cover 89 is provided to cover the thermal fuses 22, 23 or the connecting terminals 96, 97, 98, and 99 or the like inside the base body 88 so that they cannot be seen from the outside, and thus the commercial value of the appearance is not reduced. The cover 89 is engaged with the base body 88 by engagement pieces (not shown), and easily can be attached thereto. Furthermore, recesses 102, 103, 104, and 105 for receiving the slit-forming end portions of the connecting terminals 96, 97, 98, and 99 are formed on the inner surface of the cover 89. This can prevent the lead wires 9, 10, 11, and 12 from slipping off the connecting terminals 96, 97, 98, and 99 during the transportation of lamps or the like (see FIG. 23). The cover 89 can be attached to the base body simply by fitting therein, which makes it easy to achieve a lamp assembly process by automatic manufacturing equipment.

As shown in FIG. 23, the accommodating holes 100 (101) are substantially sealed with accommodating covers 100*a* (101*a*) made of the same resin material as the base body 88, using ultrasonic welding or the like. This structure is used for preventing oxidation of the surfaces of the thermal fuses 22, 23 that are exposed to an atmosphere of relatively high temperature (about 120° C.) during the lamp life, so that the thermal fuses 22, 23 can be melted and cut off when the temperature rises excessively in the last period of lamp life, and thus function as a protection element. The results of studies by the present inventors indicated that when the thermal fuses 22, 23 were placed merely in an open atmosphere of the base 13, the surfaces of the thermal fuses were oxidized to form a metal oxide layer of PbO or SnO or the like during the lamp life, and the thermal fuses might not function because when the temperature rose excessively, the oxide layer on the surface was not melted while the metal itself inside the thermal fuses was melted. Furthermore, it was also confirmed that filling the accommodating holes 100, 101 with reducing substances (not shown), such as pine resin or the like was effective in preventing the oxidation of the thermal fuses 22, 23 more reliably.

Figure 25:
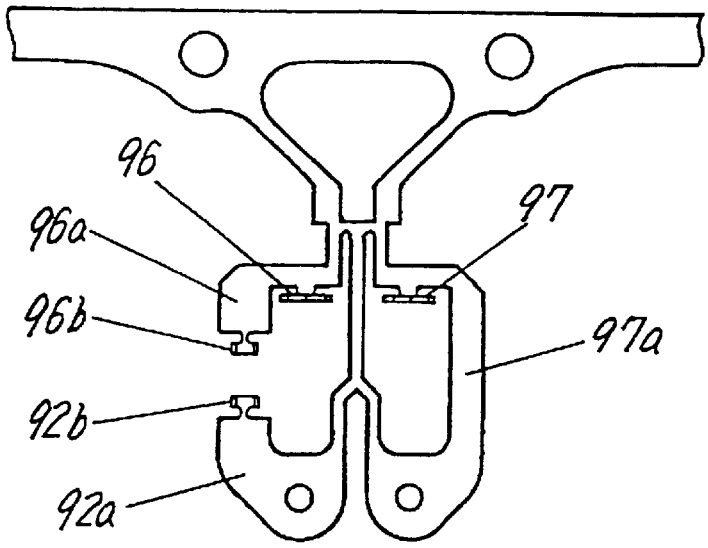
FIG. 25 is a front view showing a metal part used for power-conducting members of the base body of FIG. 20.

The use of the slit-forming terminals as the connecting terminals 96, 97, 98, and 99 facilitates the respective connections between the electrode lead wires 9, 10, 11, and 12 and the connecting terminals 96, 97, 98, and 99 by automatic manufacturing equipment. As described above, the ends of the connecting terminals 92*b*, 96*b* or the like, by which the thermal fuses 22, 23 and the lead plates 92*a*, 96*a*, 99*a*, and 95*a* are connected, have a slit or the like, so that establishing these connections by automatic manufacturing equipment is easy. In this case, of the elements that constitute the second power-conducting members 91 and the first power-conducting members 90, the metal parts, i.e., the connecting terminals 96 (99) and 97 (98), the lead plates 92*a* (95*a*), 96*a* (99*a*), and 97*a* (98*a*), and the connecting terminals 92*b*, 96*b* (or the like), can be manufactured by punching and forming a metal plate, as shown in FIG. 25. Thus, at the same time as the resin molding of the base body 88, which will be described later, these metal parts are fixed easily as an integral part of the base body 88. In that case, the base body 88 is completed by cutting the unnecessary portions of the embedded metal parts. FIG. 25 shows one of the metal parts; the other has the same structure.

An example of the processes of manufacturing the base 87 is as follows: First, at the same time as resin molding of the base body 88, the base contact pin terminals 92, 93, 94, and 95 and the connecting terminals 96, 97, 98, and 99, the lead plates 92*a*, 96*a*, 99*a*, and 95*a* and the connecting terminals 92*b*, 96*b* or the like on the end of each of the lead plates, which constitute the first power-conducting members 90 and the second power-conducting members 91, are fixed to form an integral part of the base body 88. Then, the thermal fuses 22, 23 are caulked and soldered to the connecting terminals 92*b*, 96*b* or the like on the end of each of the lead plates 92*a*, 96*a*, 95*a*, and 99*a*.

As other manufacturing processes of the base 87, the following processes can be used. First, at the same time as resin molding of the base body 88, the connecting terminals 96, 97, 98, and 99, the lead plates 92*a*, 96*a*, 95*a*, and 99*a*, and the connecting terminals 92*b*, 96*b* or the like on the end of each of the lead plates are fixed to form an integral part of the base body 88. Then, the base contact pin terminals 92, 93, 94, and 95 are forced into the predetermined positions of the base body 88 to be attached thereto, and connected to one end of each of the lead plates 92*a*, 93*a*, 94*a*, and 95*a*, respectively, by caulking. Then, the thermal fuses 22, 23 are caulked and soldered to the connecting terminals 92*b*, 96*b* or the like on the end of each of the lead plates 92*a*, 96*a*, 95*a*, and 99*a*, respectively. However, the thermal fuses 22, 23 can be fixed previously inside the base body 88 by caulking and soldering. Alternatively, the thermal fuses 22, 23 can be caulked and soldered after the fluorescent lamp manufacturing process (a), which will be described below.

An example of the manufacturing processes of a fluorescent lamp of this embodiment includes the following processes:

(a) First, the end of the light-emitting tube 1 is installed in the base body 88, and then fixed with an adhesive (not shown) of a silicone resin or the like. In this installation, the four electrode lead wires 9, 10, 11, and 12 are connected to the slit-forming connecting terminals 96, 97, 98 and 99, respectively.

(b) Then, the cover 89 is attached to the base body 88.

As described above, according to this embodiment, the first power-conducting members 90 and the second power-conducting members 91 that include the base contact pin terminals 92, 93, 94, and 95, the thermal fuses 22, 23, and the slit-forming connecting terminals 96, 97, 98, and 99, or the like are wired inside the base body 88 beforehand. The use of such a base allows a fluorescent lamp with the thermal fuse to be produced by the same processes as in the conventional fluorescent lamp without the thermal fuse. Therefore, in the manufacturing processes of a fluorescent lamp, the process performed by manual operation can be reduced and the process conventionally performed by manual operation can be facilitated by automation in comparison with the manufacturing processes of the conventional fluorescent lamp with the thermal fuse. In addition, it is possible easily to achieve the mass production of lamps by automation and to reduce significantly the manufacturing cost required for producing fluorescent lamps. Furthermore, since the thermal fuses 22, 23 are provided so as to be substantially sealed in the closed accommodating holes 100, 101, the oxidation of the thermal fuses 22, 23 during lamp life is prevented. Thus, the thermal fuses 22, 23 are melted and cut off reliably when the temperature rises excessively in the last period of lamp life, so that fluorescent lamps with excellent safety can be obtained.

Eighth Embodiment

Figure 26:
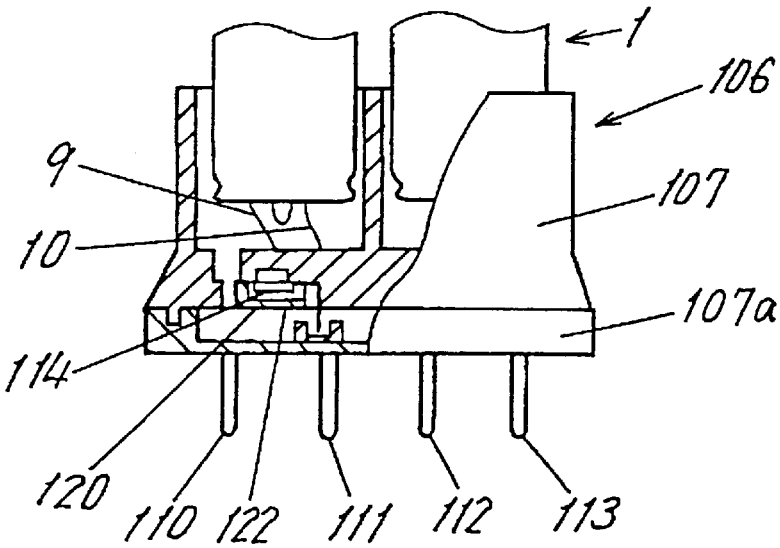
FIG. 26 is a sectional front view showing a substantial part of a fluorescent lamp of an eighth embodiment of the present invention.
Figure 27:
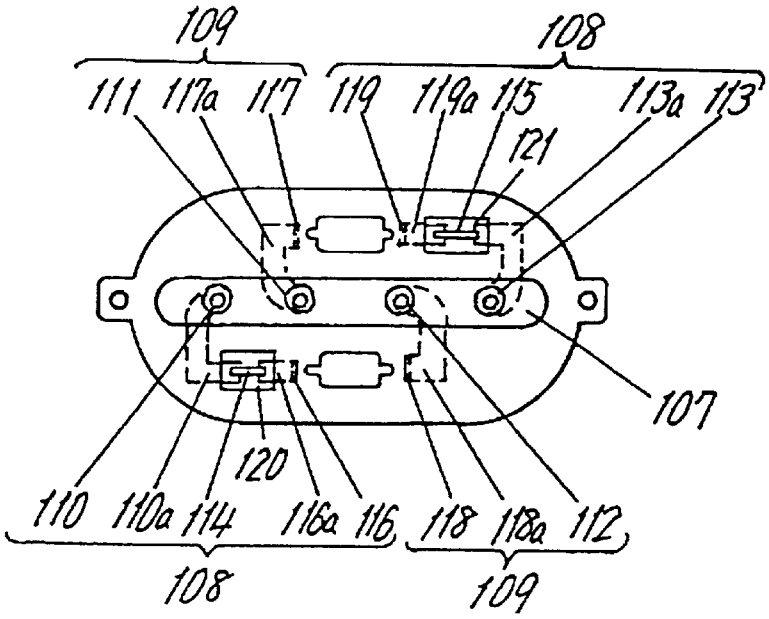
FIG. 27 is a bottom view showing a base body of the fluorescent lamp of FIG. 26.
Figure 28:
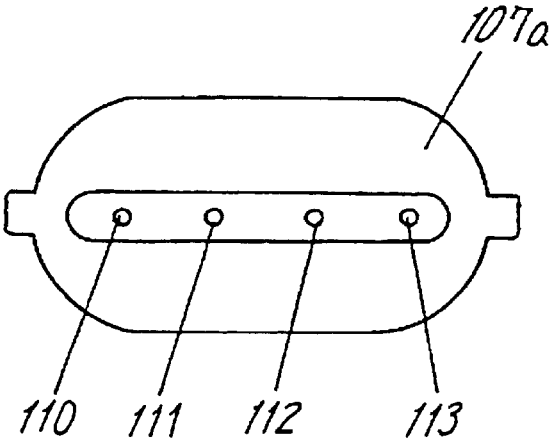
FIG. 28 is a bottom view of a base including the base body of FIG. 27 provided with a cover.

A base 106 of a fluorescent lamp of an eighth embodiment of the present invention will be described with reference to FIGS. 26 to 28.

The base 106 includes a base body 107 and a cover 107*a*. In the base body 107, four base contact pin terminals 110, 111, 112, and 113 that constitute first power-conducting members 108 and second power-conducting members 109 are arranged linearly. With the linear arrangement of the base contact pin terminals 110, 111, 112, and 113, the shapes or the positions of installation or the like of the base contact pin terminals 110, 111, 112, and 113, thermal fuses 114, 115, the slit-forming connecting terminals 116, 117, 118, and 119, lead plates 110*a*, 113*a*, 116*a*, 117*a*, 118*a*, and 119*a*, and the cover 107*a* or the like are properly adjusted. The electrode lead wires 9, 10, 11, and 12 are connected to the connecting terminals 116, 117, 118, and 119. The thermal fuses 114, 115 are provided in the closed accommodating holes 120, 121, respectively. As shown in FIG. 26, the accommodating hole 120 is substantially sealed with an accommodating cover 122 (similarly, the accommodating hole 121 is also substantially sealed). Furthermore, the thermal fuses 114, 115 are caulked and soldered to the connecting terminals provided on the end of each of the lead plates 110*a*, 116*a*, 113*a*, and 119*a* in the same manner as in the seventh embodiment.

Other base structures and the processes of formation and assembly are basically the same as those of the seventh embodiment.

Ninth Embodiment

Figure 29:
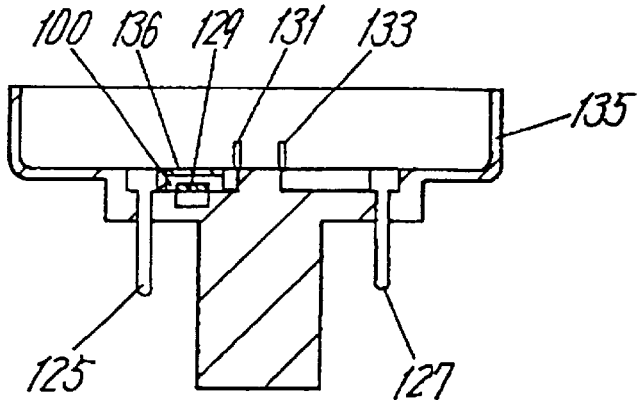
FIG. 29 is a sectional front view showing a substantial part of a fluorescent lamp of a ninth embodiment of the present invention.

A one-base-type fluorescent lamp of the six straight tubes type of a ninth embodiment will be described with reference to FIGS. 29 to 31. The basic structure is the same as that of the fourth embodiment.

Figure 30:
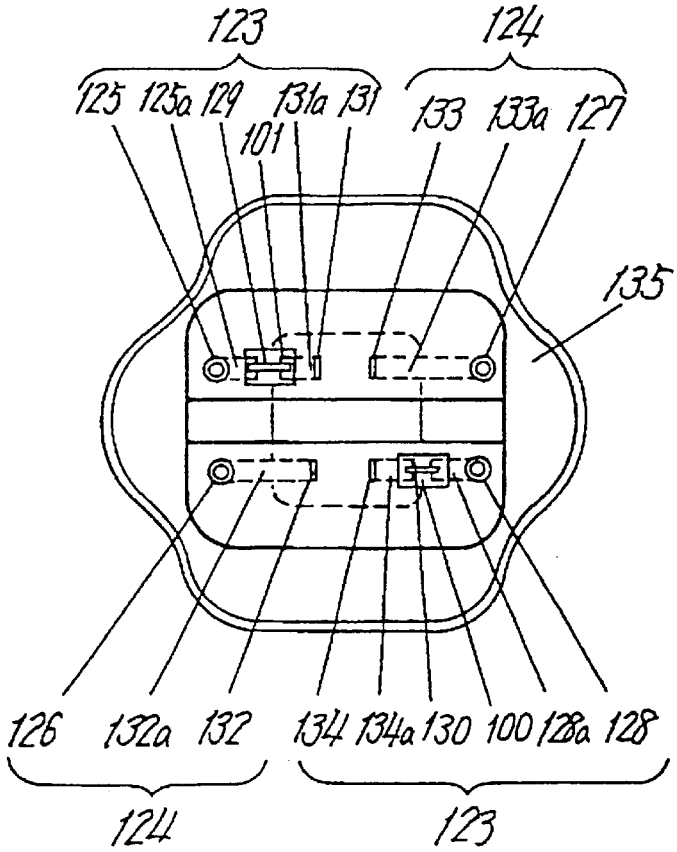
FIG. 30 is a plan view showing a base of the fluorescent lamp of FIG. 29.
Figure 31:
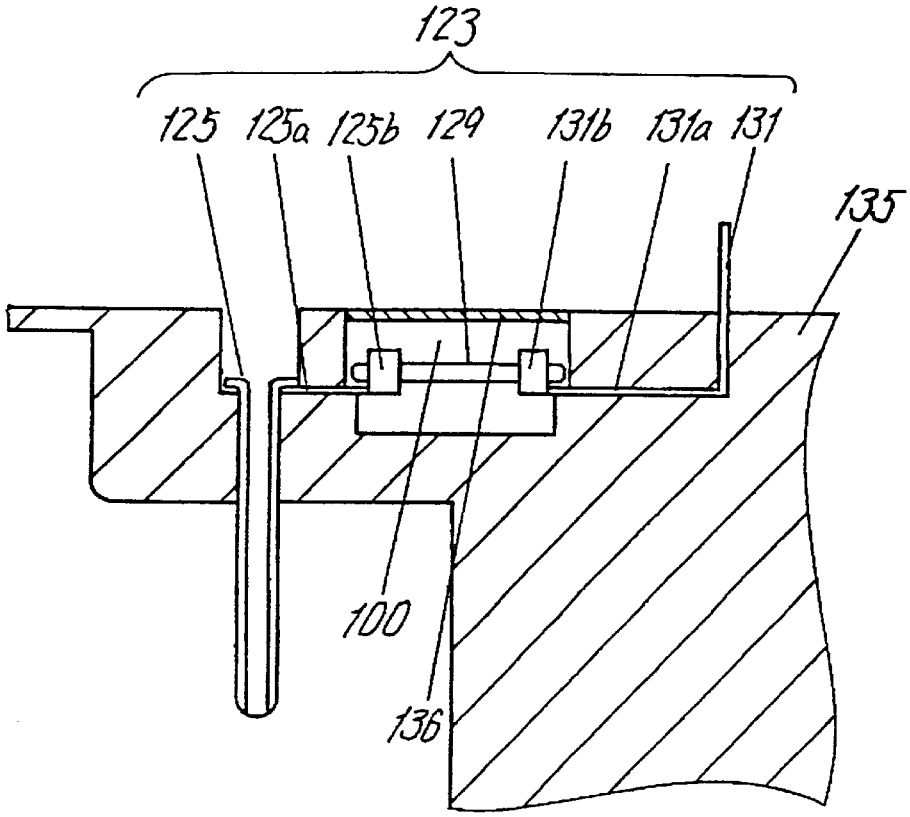
FIG. 31 is an enlarged sectional front view showing a substantial part of the base of FIG. 30.

As shown in FIG. 30, a base body 135 includes first power-conducting members 123 and second power-conducting members 124. The first power-conducting members 123 and the second power-conducting members 124 include, like each of the above embodiments, at least four base contact pin terminals 125, 126, 127, and 128, thermal fuses 129, 130, and the slit-forming connecting terminals 131, 132, 133, and 134 to which the electrode lead wires are connected.

In the first power-conducting members 123, the base contact pin terminals 125, 128 and the connecting terminals 131, 134 are connected via the thermal fuses 129, 130, respectively. In order easily to establish the connections between the base contact pin terminals 125, 128 and the connecting terminals 131, 134, the base contact pin terminals 125, 128 and the connecting terminals 131, 134 are provided with lead plates 125*a*, 128*a* and 131*a*, 134*a*, respectively, like each of the above embodiments. As shown in FIG. 31, the thermal fuse 129 is caulked and soldered to connecting terminals 125*b*, 131*b* on the end of each of the lead plates 125*a*, 131*a*, having a slit or a groove or the like (similarly, the thermal fuse 130 also is caulked and soldered to the end of each of the lead plates 128*a*, 134*a*).

On the other hand, in the second power-conducting members 124, the base contact pin terminals 126, 127 and the connecting terminals 132, 133 are connected by lead plates 132*a*, 133*a*. The connecting terminals 132, 133 and the lead plates 132*a*, 133*a* are formed as an integral part, respectively. The base contact pin terminals 126, 127 are attached to one end of each of the lead plates 132*a*, 133*a* by caulking.

Being connected in the manner described above, the thermal fuses 129, 130 of the first power-conducting members 123 are accommodated in accommodating holes 100, 101 provided in the base body 135. Furthermore, the accommodating holes 100, 101 are substantially sealed with accommodating covers 136 made of the same resin material as the base body 135 by ultrasonic welding.

Like each of the above embodiments, in forming the base body 135, part of the first power-conducting members 123 and the second power-conducting members 124, i.e., the portion in the area that does not cause interference with the connection to an outer electronic lighting circuit or the electrode lead wires or the like, is embedded in the base, so that the first power-conducting members 123 and the second power-conducting members 124 are formed to be integral with the base.

Figure 32:
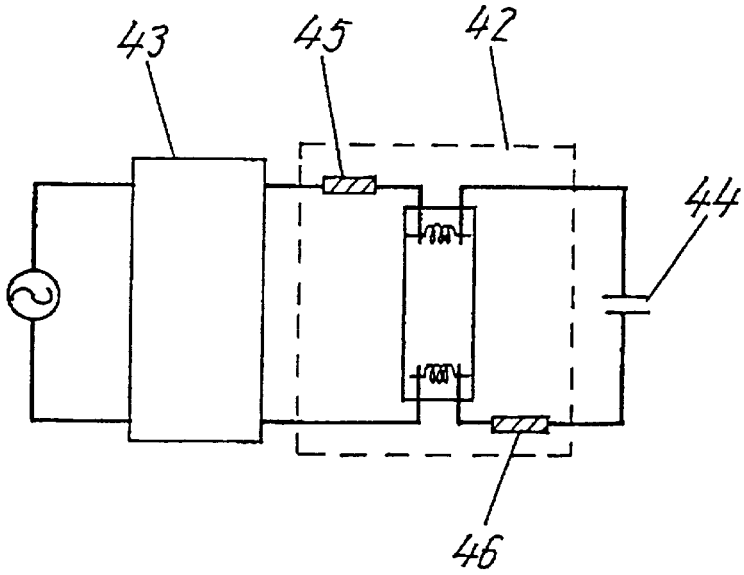
FIG. 32 is a view for describing a circuit configuration of a lighting circuit for lighting a fluorescent lamp of the present invention.
Figure 33:
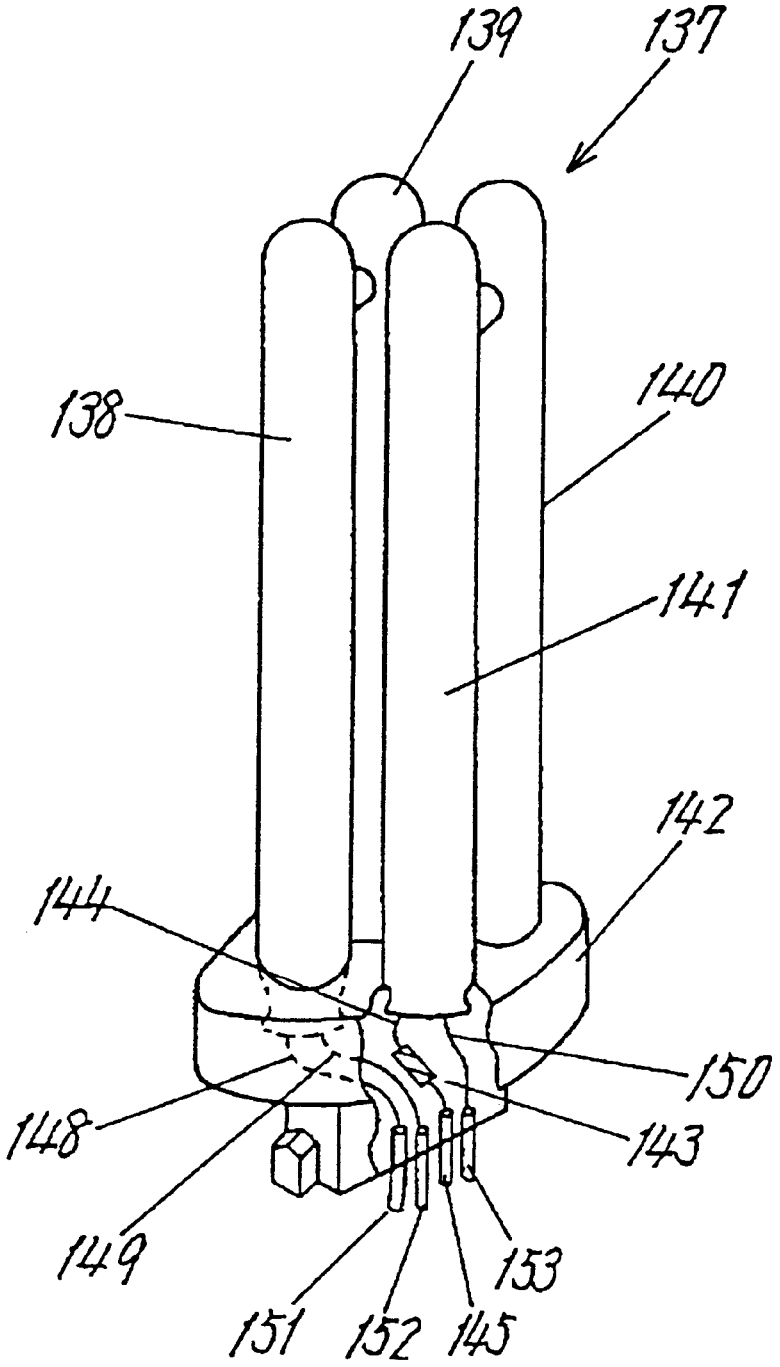
FIG. 33(PRIOR ART)
FIG. 33 is a partial sectional perspective view showing a conventional fluorescent lamp.
Figure 34:
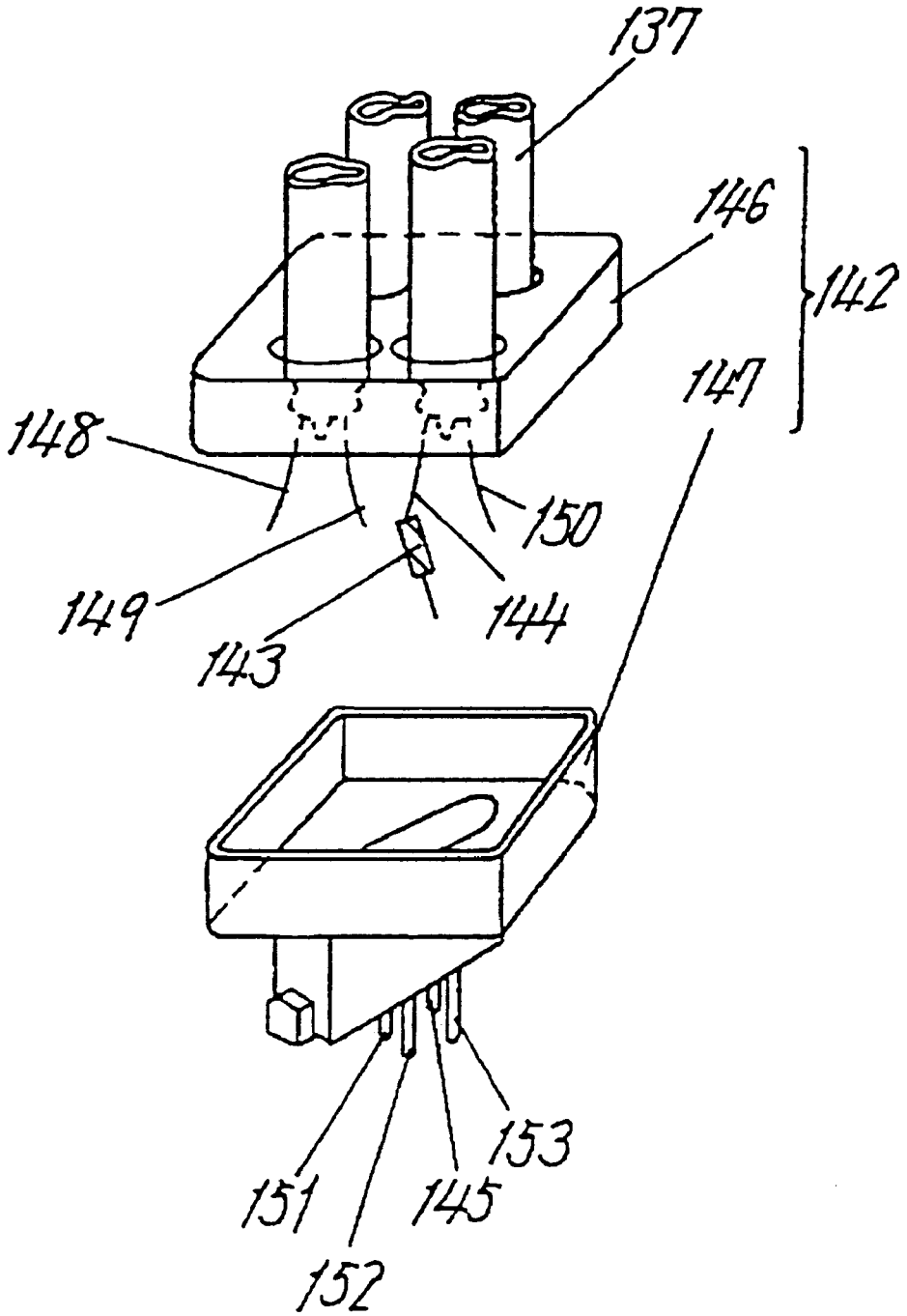
FIG. 34 (PRIOR ART)
FIG. 34 is an exploded perspective view showing a substantial part of the fluorescent lamp of FIG. 33.
Figure 35:
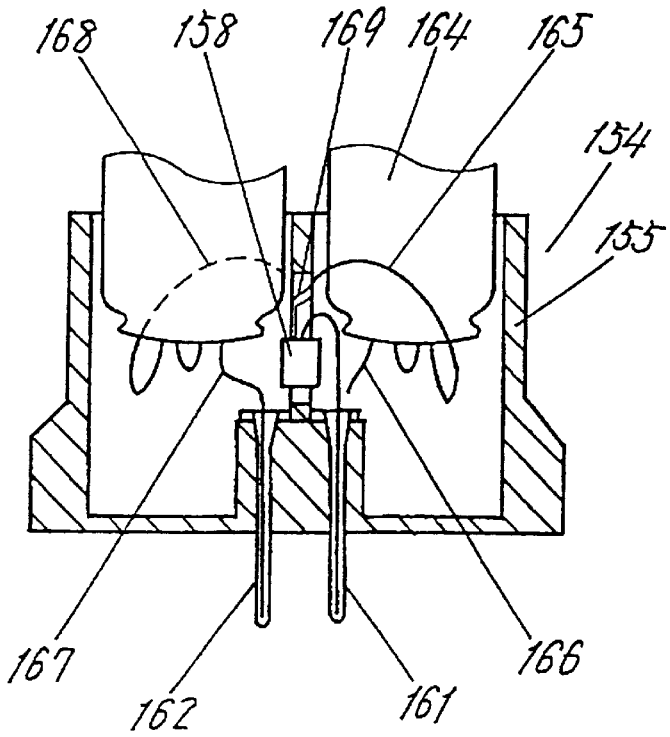
FIG. 35(PRIOR ART)
FIG. 35 is a sectional front view showing a base portion of the fluorescent lamp of FIG. 33.
Figure 36:
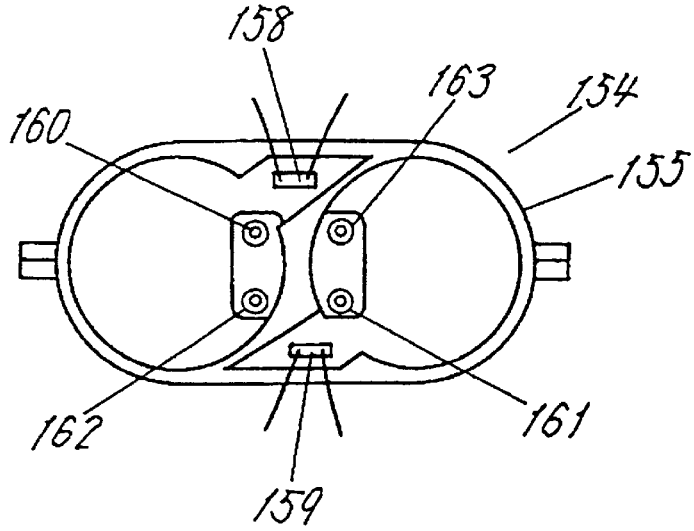
FIG. 36(PRIOR ART)
FIG. 36 is a plan view showing a base of the fluorescent lamp of FIG. 33 without a cover.
Figure 37:
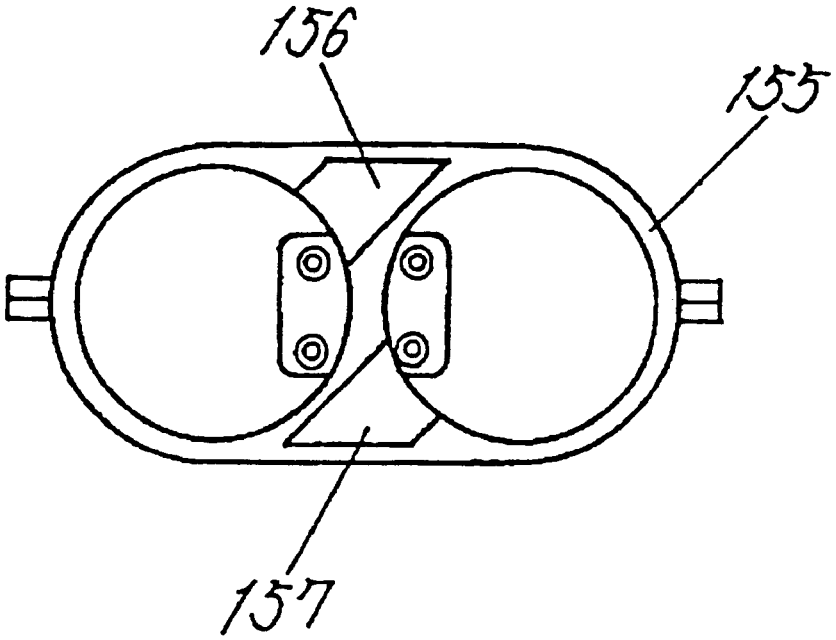
FIG. 37 (PRIOR ART)
FIG. 37 is a plan view showing a base of the fluorescent lamp of FIG. 33 with covers attached.

In each of the above embodiments, the number of thermal fuses to be used is preferably at least two. However, it is not necessarily two; one, three, or four may be used. The reason that the use of at least two thermal fuses is preferable is as follows. A one-base-type fluorescent lamp is generally lit by an electronic lighting circuit system shown in FIG. 32. In FIG. 32, among four electrode lead wires of a lamp 42, two are connected to a high-frequency electronic circuit 43 and the remaining two are connected to a capacitor 44. Therefore, in the last period of lamp life, it is preferred to interrupt application of a voltage from the high-frequency electronic circuit 43 to the lamp 42. This requires that at least one thermal fuse is inserted between the lamp 42 and the high-frequency electronic circuit 43. On the other hand, if only one thermal fuse is used, the thermal fuse may be inserted between the capacitor 44 and the lamp 42, depending on the polarity of the socket attachment of a lamp base. Thus, when a lamp has two thermal fuses 45, 46 as shown in FIG. 32, application of a voltage from the high-frequency electronic circuit 43 always can be interrupted in the last period of lamp life, regardless of the polarity of the socket insertion of a lamp base.

In each of the above embodiments, one-base-type fluorescent lamps of the two and six straight tubes types have been described. However, the present invention can also be applied to other one-base-type fluorescent lamps of the two, four, and eight straight tubes types.

The result of life tests of the one-base-type fluorescent lamp of each of the above embodiments and studies of the condition in the last period of lamp life confirmed that the thermal fuse provided in the lamp was melted and cut off reliably when the temperature rose excessively in the last period of lamp life. Therefore, it is clear that the fluorescent lamp of each of the embodiments can provide excellent safety.

As described above, by including the configuration shown in each of the above embodiments, the manufacturing processes of a fluorescent lamp can be simpler and easier than those of the conventional lamps. In addition, the mass production of lamps by a series of automatic manufacturing equipment easily can be achieved. Thus, the manufacturing cost required for producing fluorescent lamps can be significantly reduced. Furthermore, a fluorescent lamp with excellent safety can be obtained that ensures that the thermal fuse provided in the lamp is melted and cut off as the temperature rises excessively in the last period of lamp life.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A fluorescent lamp comprising:

a light-emitting tube having a pair of electrodes therein;

a base for fixing the light-emitting tube; and a base contact pin terminal supported by the base with one end thereof projecting from the base, the base contact pin terminal being electrically connected to an electrode lead wire drawn from the light-emitting tube, wherein the base is provided with a first power-conducting member including the base contact pin terminal having a lead plate, a connecting terminal having a lead plate and connected to the electrode lead wire, and a thermal protection element connected to an end of the lead plate of the base contact pin terminal and an end of the lead plate of the connecting terminal.

2. The fluorescent lamp according to claim 1, wherein the base is provided with, in addition to the first power-conducting member, a second power-conducting member including the base contact pin terminal, a connecting terminal connected to the electrode lead wire, and a lead plate connecting the base contact pin terminal and the connecting terminal.

3. The fluorescent lamp according to claim 1, wherein the base is provided with a cover for covering the thermal protection element and the lead plates of the base contact pin terminal and the connecting terminal.

4. The fluorescent lamp according to claim 1, wherein at least part of the base contact pin terminal and the connecting terminal, or at least part of each of the lead plates provided on the base contact pin terminal and the connecting terminal is embedded in the base.

5. The fluorescent lamp according to claim 4, wherein the base has a accommodating hole in which the thermal protection element is accommodated, and the base contact pin terminal and the connecting terminal are embedded in the base so that an end of each of the lead plates of the base contact pin terminal and the connecting terminal, to which the thermal protection element is connected, is positioned in the accommodating hole.

6. The fluorescent lamp according to claim 5, wherein the accommodating hole is covered with an accommodating cover.

7. The fluorescent lamp according to claim 5, wherein the accommodating hole in which the thermal protection element is accommodated is filled with a reducing substance.

8. The fluorescent lamp according to claim 1, wherein a connected portion between the electrode lead wire and the connecting terminal is a slit-forming terminal.

9. The fluorescent lamp according to claim 2, wherein the second power-conducting member includes a structure in which the lead plate to be attached to the base contact pin terminal and the lead plate to be attached to the connecting terminal are composed of an integral member made of a metal plate.

10. The fluorescent lamp according to claim 3, wherein a connected portion between the electrode lead wire and the connecting terminal is a slit-forming terminal, and a recess for receiving the slit-forming connecting terminal is provided on an inner side of the cover.

11. The fluorescent lamp according to claim 7, wherein the reducing substance is pine resin.

* * * * *